US009683356B1

(12) United States Patent
Selius

(10) Patent No.: US 9,683,356 B1
(45) Date of Patent: Jun. 20, 2017

(54) AUGER ARRANGEMENT FOR UNCLOGGING PIPES

(71) Applicant: Leslie Sau Selius, Larchmont, NY (US)

(72) Inventor: Leslie Sau Selius, Larchmont, NY (US)

(73) Assignee: Leslie Sau Selius, Larchmont, NY (US)

( * ) Notice: Subject to any disclaimer, the term of this patent is extended or adjusted under 35 U.S.C. 154(b) by 0 days.

(21) Appl. No.: 15/159,422

(22) Filed: May 19, 2016

(51) Int. Cl.
*E03F 9/00* (2006.01)
*E03C 1/302* (2006.01)
*B08B 9/04* (2006.01)

(52) U.S. Cl.
CPC ..... *E03C 1/302* (2013.01); *B08B 9/04* (2013.01)

(58) Field of Classification Search
CPC ..... B08B 9/02; B08B 9/045; E03C 1/302
See application file for complete search history.

(56) References Cited

U.S. PATENT DOCUMENTS 2,450,486 A * 10/1948 Perry ..... E03C 1/302 15/104.095
2008/0184509 A1* 8/2008 Doty ..... B08B 9/045 15/104.095
2009/0320197 A1* 12/2009 Turner ..... E03C 1/302 4/255.01

* cited by examiner

*Primary Examiner* — Shay Karls
(74) *Attorney, Agent, or Firm* — Leason Ellis LLP

(57) ABSTRACT

An auger type device for unclogging a clogged plumbing system is disclosed. The device includes a housing defining an inner cavity and having a side wall, an end wall, an opening, a rotatable shaft, and a handle. The opening provides a passageway for the wire in an extended condition. The housing has a multi-functional adaptor structured on the outside of the housing. In one condition, the adaptor adapts the device to engage a plumbing system, wherein a unified plumbing cleaning system is created. In another condition, the adaptor adapts the device to an introducer cap wherein the nozzle-shaped protrusion of the cap directs the wire of the device into the drain. The multi-functional adaptor is sized and shaped to engage a normal plumbing system and the introducer cap.

15 Claims, 3 Drawing Sheets

AUGER ARRANGEMENT FOR UNCLOGGING PIPES

FIELD OF THE INVENTION

The present invention concerns accessories for drain cleaning. More particularly, the invention concerns a device for the unclogging of a clogged drain.

BACKGROUND OF THE INVENTION

Since the emergence of modern plumbing systems, the living environment of humans has been greatly improved. Cities are cleaner, and people live a more sanitary lifestyle. Various types of plumbing systems have been developed since then, but a typical plumbing system comprises a drain, pipes, valves, fittings and fixtures installed for the distribution of potable water for daily use. Clogging is a common hassle that some plumbing systems have. Some of the most common causes of clogs are soap, grease, food residuals, human hair, particles and mineral sediments, and foreign objects (e.g., a piece of a toy), which will be referred to herein as clogging debris, but it is to be understood that any possible clogging material can cause a clogging. Clogging is caused by the accumulation of clogging debris at one location of a plumbing system to the extent that it prevents water to pass through.

Current technologies provide both physical solutions (e.g., air pump, drain snake) to unclog a clogged plumbing system, and non-physical solutions (e.g., biological or chemical solutions/gels). For decades, drain snakes have been among the most popular physical unclogging devices. A drain snake is an auger type device that is used to unclog clogged drains, sewers, pipes, etc. It is also sometimes called a plumber's snake, or a sewer snake. A typical drain snake comprises a long and thick metal wire. This design can be relatively big and heavy.

In some situations where clogging of a drain has occurred, a drain snake can be used, whether by a residential home owner or by a professional plumber. To use a typical drain snake, the wire of the snake is thread through a drain hole and into a drain pipe system. The wire is then pushed forward along the pipe to reach the location of the clog. After the plumbing system is unclogged, the wire is retracted from the pipe. In some conditions, the user uses her bare hands to touch, advance, and/or rotate the wire. This process is both inconvenient and creates sanitary issues. Using a drain snake can be unsanitary because the drain snakes are not typically closed systems and the wires are often exposed. For the same reason, when the wire is retracted from the plumbing system, sewer water residual left on the wire will be exposed to the living environment. Moreover, some auger tips are sharp and pointed, and it can be dangerous for the user to handle such device with bare hands. Accordingly, when using a typical drain snake, the user has to be careful and avoid potential injury from the auger tip. After the user is finished using the drain snake, she may need to pay attention to clean her hands, as well as the surrounding environment. Further, because a drain snake is not part of the plumbing system, it requires extra storage space, which is both inconvenient and creates further sanitary concerns because residual debris or other contaminants could be left on the wire. For the same reason, since it takes extra effort to locate and setup the device every time before use, a user tends not to use a typical drain snake in a preventive manner, such as for routine periodic use (e.g., monthly) to maintain the drain system.

As an alternative to physical unclogging devices, products including biological organisms or chemical solutions can be used. For instance, a user can pour such a solution into the clogged drain, and the solution will gradually dissolve the clogging debris. Non-physical solutions can have several disadvantages. First, active ingredients in these chemical products can degrade over time. Therefore, chemical solutions typically have shorter life than physical devices. Second, certain ingredients in chemical solutions are harmful to humans and/or the environment. A typical chemical solution comprises ingredients such as strong alkaline/acids or chemical derivatives of a strong alkaline/acid. Such ingredients, usually during their degradation, can release poisonous gas or other byproducts that are harmful to humans and living environment. Therefore, chemical solutions can create safety concerns.

The present invention addresses these and other problems by providing a unified, self-contained, chemical-free unclogging device that can be adapted to a home plumbing system.

SUMMARY OF THE INVENTION

According to one aspect of the invention, an auger device (unclogging device) of a type suitable for unclogging a clogged pipe disposed in a plumbing system includes a cylindrical housing having a side wall and an end wall. The side wall and the end wall define an inner cavity. The device includes a rotatable shaft is disposed within the inner cavity of the housing. A handle is attached to the rotatable shaft. The handle extends through the end wall of the housing such that the handle can be manipulated from outside the housing. A seal is disposed about the handle. The seal is sized and shaped to prevent water from leaking from the inner cavity through the end wall to the outside of the housing. There is a wire disposed about the shaft in a retracted condition. Rotation of the handle in a first direction causes the shaft to rotate and the wire to extend outwards from the inner cavity of the housing. Rotation of the handle in a second direction causes the wire to retract into the inner cavity of the housing. The device further includes a multi-function adaptor disposed at an opposite end of the housing. The adaptor is adapted to engage pipes of a plumbing system in a first configuration and the adaptor is adapted to engage an introducer cap in a second configuration. The adaptor is sized and shaped to direct the wire into a drain in an extended condition in which the handle is rotated in the first direction.

In a more particular, optional arrangement, the auger device further includes threads. The threads are sized and shaped to engage a pipe connection of the plumbing system.

In a more particular optional arrangement, the auger device and the adaptor include threads that are sized and shaped to engage the introducer cap.

In a further optional arrangement, the introducer cap includes a protrusion. The protrusion defines a passageway that is sized and shaped to allow the wire to pass from the inner cavity, through the passageway, and to the outside of the housing. The protrusion extends from the cap and is sized and shaped to be inserted through a hole in a drain cover to direct the wire past the drain cover and into the drain.

In a more particular optional arrangement, the shaft of the device includes helically pitched grooves that receive the wire in the retracted condition.

According to the optional arrangement, the inner surface of the side wall includes grooves that receive the wire in the retracted condition.

These and other aspects, features, and advantages can be appreciated from the accompanying description of certain embodiments of the invention and the accompanying drawing figures and claims.

DESCRIPTION OF THE DRAWING FIGURES

DETAILED DESCRIPTION OF CERTAIN EMBODIMENTS OF THE INVENTION

By way of overview and introduction, the present invention is described in detail in connection with a unified, multifunctional, compact auger device for unclogging a clogged plumbing system.

Figure 1:
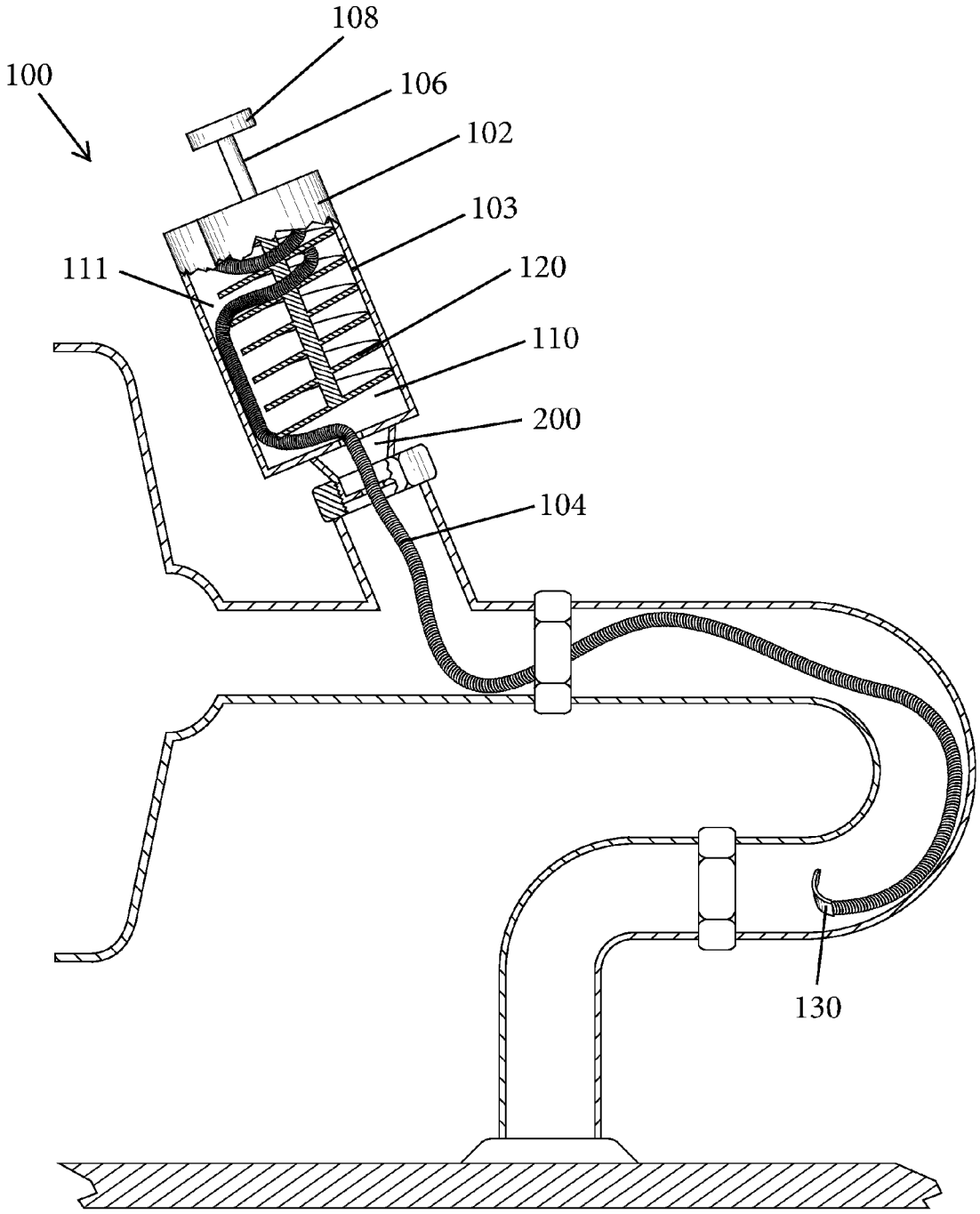
FIG. 1 is a cross-section view of an unclogging device applied to a unified system in accordance with one or more embodiments.
Figure 2:
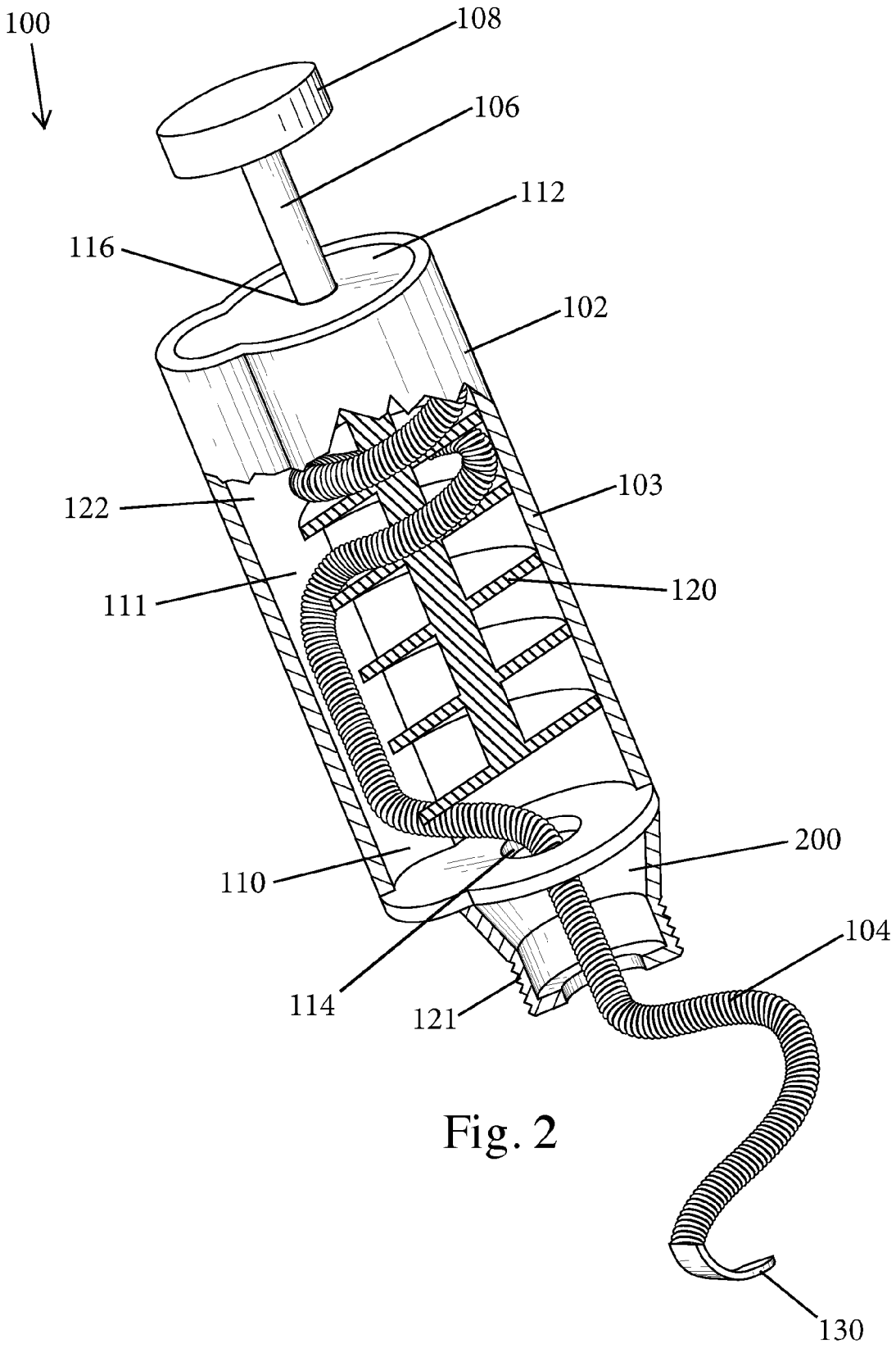
FIG. 2 is a cross-section view of an unclogging device with a multi-function adaptor in accordance with one or more embodiments.

In at least one embodiment, referring to FIGS. 1 and 2, a drain cleaning auger device 100 includes a housing 102, a wire 104, a rotatable shaft 106, and a handle 108. A multifunctional adaptor 200 is configured to engage pipes of a plumbing system in a first configuration and the adaptor is configured to engage an introducer cap 300 in a second configuration (see FIG. 3). The adaptor 200 can be provided in multiple sizes to fit different plumbing systems. The connection of the auger device 100 to the plumbing system (e.g., via adaptor 200) makes the auger device 100 part of a "unified" plumbing system.

The housing 102 that defines an inner cavity 110 has a side wall 103 and an end wall 112. The housing 102 is illustrated as being cylindrical in shape, but other shapes are contemplated. The housing 102 can have a larger diameter than the plumbing system to which it connects, so that the housing 102 can hold longer wires with larger diameter. The adaptor is sized and shaped to allow the housing to connect to plumbing systems. A rotatable shaft 106 is disposed within the housing 102. A handle 108 is attached to one end of the shaft. The wire 104 is disposed about the shaft 106 in a retracted condition. The housing has an opening 114 opposite to the end wall 112 that allows the wire 104 to extend outwards. In one condition, the handle 108 is turned in a first direction, causing the shaft 106 to rotate and the wire 104 to extend outwards from the inner cavity 110 of the housing 102. The wire 104 can be wrapped or coiled about the shaft 106, which can also be a helical wrapping, such that rotation of the shaft causes the wire to unwrap and be ejected from the housing 102. In one or more embodiments, as shown in FIGS. 1 and 2, the inner cavity 110 comprises a pathway 111 along the length of the sidewall 102 configured to accommodate the wire 104 as it extends outwardly from the inner cavity of the housing. In another condition, the handle 108 is rotated in a second direction, causing the wire 104 to retract into the inner cavity 110 of the housing 102 (e.g., the wire can wrap around the shaft 106). The housing 102 can be made from metal, plastic, or other material. Plastic and coated metal can be used due to their impermeability, ability to withstand water corrosion and rust, and relative low cost and ease of manufacture. For the same reason, the handle 108 and the rotatable shaft 106 can be made from metal, plastic, or other suitable material.

A seal 116 is disposed about the handle 108. The seal 116 is sized and shaped to be disposed adjacent the rotatable shaft 106 and the end wall 112 to prevent leakage through any gap, cavity, or space between the shaft 106 and end wall 112. The seal 116 can be made from elastic rubber/gum elastic, plastic, or other material. Rubber and elastic can be used due to its impermeability, ability to withstand water corrosion and rust, relative low cost and ease of manufacture, and resilient sealing capabilities.

In one or more embodiments, the wire 104 is disposed about the rotatable shaft 106 in a retracted condition. For instance, one end of the wire can be fastened to the rotatable shaft 106. In one or more embodiments, the shaft 106 optionally includes grooves 120 that receive the wire 104 in the retracted condition. In a preferred embodiment, the grooves 120 are helically pitched grooves. In at least one embodiment, the wire 104 can be a coiled wire with a tip 130 at the end of the coil that is flatter relative to the rest of the coiled wire. Providing a coiled wire increases the flexibility of the wire, which permits it to more easily insert into tortured plumbing paths and to retract into the device.

Turning the handle 108 in a first direction causes the rotatable shaft 106 to rotate. In an embodiment in which the wire 104 is wrapped around the shaft 106, rotating the shaft 106 via the handle 108 drives the wire 104 along the grooves 120 to extend outwards from the inner cavity of the housing 102. Turning the handle 108 in the opposite direction causes the rotatable shaft 106 to rotate, and to retract the wire 104 into the grooves 120 between the rotatable shaft 106 and the inner surface 122 of the inner cavity of the housing 102.

In at least one embodiment, an inner surface 122 of the side wall 103 includes the grooves 120 that receive the wire in the retracted condition, as can be seen in FIG. 2. A multifunctional adaptor 200 can also be disposed on the outside of the housing 102, opposite to the end wall 112 of the housing 102. The adaptor 200 is configured to permit the housing to engage the pipes of a plumbing system. The adaptor 200 can include threads 121 that are sized and shaped to engage pipes of a plumbing system. In one embodiment, the auger device is attached to a plumbing system through adaptor 200, as can be seen in FIG. 1. The connection between the auger device 100 and the plumbing system is sealed tightly by the adaptor 200. In one or more embodiments, application of water-proof tape to the joints of the connection further prevents the water from leaking (e.g., plumber's tape, sealing compound, or other such material). In certain embodiments, the adaptor 200 can also be sized and shaped to attach to the plumbing system via a slip nut and gasket, for example, that provide a water tight seal between the device and the plumbing system. If the device is removed from the plumbing system, the plumbing system can then be sealed (e.g., via a tuned plug or a slip nut type plug).

According to one example, the auger device of the present application can be connected to drain pipes located under a sink that are accessible via the doors of a sink cabinet (e.g., kitchen sink cabinet). If a clog in the drain pipes occurs, a user can open the cabinet doors to access the device. A user can turn the handle 108 in one direction, causing the rotatable shaft 106 to rotate, and drive the wire to extend outwards from the inner cavity of the housing 102, into the pipes of the plumbing system. The user can keep turning the handle 108 in the same direction until the wire 104 it deployed outwardly from the housing a sufficient amount such that the wire reaches the location of clog. The mechanical interaction between the wire and the clog can dislodge the clog and clear the pipes. After the clog is dislodged, the user can turn the handle 108 in an opposite direction causes the rotatable shaft 106 to rotate, and causes the wire to retract from the pipe of the plumbing system and into the inner cavity of the housing 102. In some conditions, if the clog is not dislodged immediately, the user can slightly turn the handle in the opposite direction and then turn the handle in the first direction, shimmying the wire 104, and dislodge the clogging debris.

During the unclogging process, the wire 104, the sewer water, and the clogging debris are separated from the user and the user's living environment because the wire is contained within the plumping pipes or the housing 102 of the device throughout the unclogging process. Therefore, it reduces the chances that the user and the surrounding areas are exposed to sewer water and/or clogging debris. Moreover, because the unclogging device of the present application is part of the unified plumbing system, the wire 104 does not require human direct touch to be successfully operated. This further reduces the chance of the user coming into contact with the wire or the wire contaminating the surrounding areas. Therefore, the device greatly diminishes the likelihood of the unclogging process contaminating the surrounding area, and greatly avoids creating sanitation concerns.

Figure 3A:
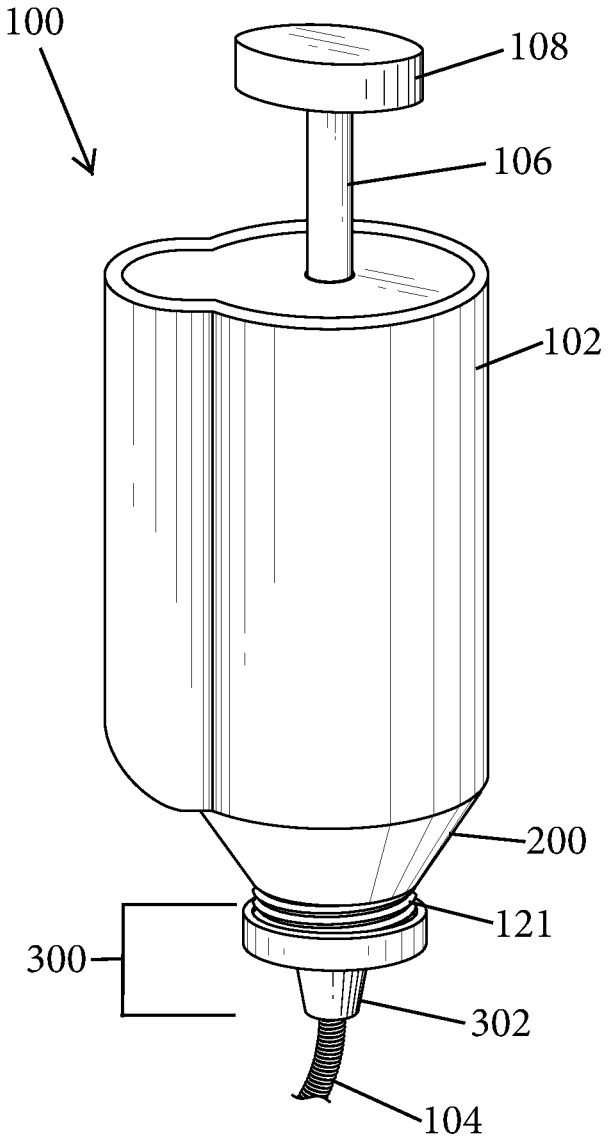
FIG. 3A is a side view of an introducer cap including a protrusion in accordance with one or more embodiments.
Figure 3B:
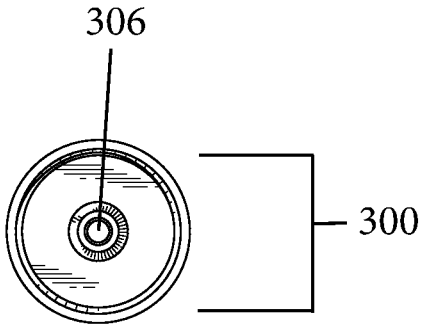
FIG. 3B is a top view of the introducer cap in accordance with one or more embodiments.
Figure 3C:
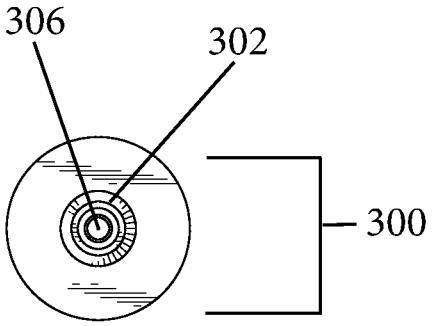
FIG. 3C is a bottom view of the introducer cap in accordance with one or more embodiments.

Referring to FIG. 3, in at least one embodiment an introducer cap 300 can be attached to the device via adaptor 200. The introducer cap 300 can include a nozzle-shaped protrusion 302. The protrusion 302 defines an inner passageway 306. In at least one embodiment, the adaptor 200 is sized and shaped to engage the introducer cap 300, as can be seen in FIG. 3A (e.g., via threads 121). The adaptor 200 can be the same as shown in FIG. 2 such that the device can be connected to a plumbing system directly or to the introducer cap 300.

Turning the handle 108 in one direction causes the rotatable shaft 106 to rotate, and drives the wire to extend outwards from the inner cavity of the housing 102, through the passageway 306, and to the outside of the housing. Turning the handle 108 in an opposite direction causes the rotatable shaft 106 to rotate in an opposite direction, and drives the wire to retract the wire 104 into the inner cavity of the housing 102. The protrusion 302 provides a guide track for directing the wire 104 as it exits the housing 102. The protrusion 302 is sized and shaped so that it may pass through the holes in a typical drain grate. Accordingly, in one or more embodiments, the protrusion 302 can be inserted through the holes of a drain grate so that the wire 104 exits the device, and it automatically and directly enters the drain. This reduces the need to manually guide the wire into the drain. Moreover, since the protrusion 302 extends through the drain grate, the wire 104 remains on the plumbing side of the drain system during use. This greatly reduces the chance of the user coming into contact with the wire or the wire contaminating the surrounding areas. The protrusion 302 can also include a deformable seal through which the wire passes. Accordingly, as the wire 104 is being retracted after use, the seal can act to wipe the wire to remove solid contaminants and/or liquid. This further enhances the cleanliness of the use of the device. In addition, it limits contaminants from entering the housing 102 of the device 100, thereby protecting the device from corrosion or jamming issues. Also, the seal reduces the chances of a user being exposed to contaminants and sewer water dripping on the floor after the device is removed from the drain and return to storage.

According to one example of use, the introducer cap 300 is screwed on the housing 102. The user applies the device 100 with the introducer cap 300 to a drain grate and inserts the protrusion 302 into a hole of the drain grate. The user can then rotate the handle 108 in one direction, causing the wire 104 to be deployed from the housing 102. The wire 104 extends through the drain grate, into the drain pipe, and reaches the clogging debris and dislodges the clogging debris. In some conditions, the user may need to shimmy the drain cleaning device because the clogging debris is not dislodged immediately. The user can the turn the handle 108 in an opposite direction to retract the wire 104 into the housing 102. This design provides a universal use. If existing plumbing does not permit attachment directly to drain pipe, as shown in FIG. 1, the introducer cap allows for sanitary use to unclog a clogged drain.

While the invention has been described in connection with certain embodiments thereof, the invention is not limited to the described embodiments but rather is more broadly defined by the recitations in any claims that follow and equivalents thereof.

What is claimed is:

1. A drain cleaning device mated to a plumbing system, comprising:

a cylindrical housing having a sidewall and an end wall at one end of the housing, the sidewall and end wall defining an inner cavity, the sidewall having a longitudinal opening, a channel disposed on an exterior portion of the sidewall and defining a channel cavity, wherein the channel cavity is in communication with the inner cavity through the longitudinal opening;

a rotatable shaft disposed within the inner cavity of the housing;

a handle attached to one end of the shaft, wherein the handle extends through the end wall of the housing such that the handle can be manipulated from outside the housing;

a seal disposed about the handle and being sized and shaped to prevent water from leaking from the inner cavity through the end wall to the outside of the housing;

a wire disposed about the shaft in a retracted condition such that rotation of the handle in a first direction causes the shaft to rotate and the wire to extend outwards from the inner cavity of the housing and rotation of the handle in a second direction causes the wire to retract into the inner cavity of the housing; and a multi-function adaptor disposed at an opposite end of the housing, the adaptor being adapted to engage pipes of a plumbing system in a first configuration and the adaptor being adapted to engage an introducer cap in a second configuration, the adaptor being sized and shaped to direct the wire into a drain in an extended condition in which the handle is rotated in the first direction.

2. The drain cleaning device of claim 1, wherein the adaptor includes threads that are sized and shaped to engage a pipe connection of the plumbing system.

3. The drain cleaning device of claim 1, wherein the adaptor includes threads that are sized and shaped to engage the introducer cap.

4. The drain cleaning device of claim 3, wherein the introducer cap includes a protrusion, the protrusion defining a passageway that is sized and shaped to allow the wire to pass from the inner cavity, through the passageway, and to the outside of the housing, the protrusion extending from the cap and being sized and shaped to be inserted through a hole in a drain cover to direct the wire past the drain cover and into the drain.

5. The drain cleaning device of claim 4, wherein the protrusion includes a deformable seal.

6. The drain cleaning device of claim 1, wherein the shaft includes grooves that receive the wire in the retracted condition.

7. The drain cleaning device of claim 6, wherein the grooves are helically pitched grooves.

8. The drain cleaning device of claim 6, wherein the gap between the grooves of the shaft and the sidewall is less than the diameter of the wire.

9. The drain cleaning device of claim 1, wherein an inner surface of the side wall includes grooves that receive the wire in the retracted condition.

10. The drain cleaning device of claim 9, wherein the grooves are helically pitched grooves.

11. The drain cleaning device of claim 1, wherein the wire is a coiled wire.

12. The drain cleaning device of claim 11, wherein the coiled wire further comprises a tip, wherein the tip is flatter relative to the coiled wire.

13. The drain cleaning device of claim 1, wherein the channel cavity is configured to accommodate the wire as it extends outwardly from the inner cavity of the housing.

14. The drain cleaning device of claim 1, wherein the rotatable shaft has a length shorter then a length of the cylindrical housing.

15. A drain cleaning device, comprising:

a cylindrical housing having a sidewall and an end wall at one end of the housing, the sidewall and end wall defining an inner cavity having a diameter D, the sidewall having a longitudinal opening, a channel disposed on the sidewall defining a channel cavity, wherein the channel cavity is in communication with the inner cavity through the longitudinal opening;

a rotatable shaft disposed within the inner cavity of the housing and equipped with helical grooves, wherein the total diameter of helical grove is about D;

a handle attached to one end of the shaft, wherein the handle extends through the end wall of the housing such that the handle can be manipulated from outside the housing;

a seal disposed about the handle and being sized and shaped to prevent water from leaking from the inner cavity through the end wall to the outside of the housing;

a wire disposed about the shaft in a retracted condition such that rotation of the handle in a first direction causes the shaft to rotate and the wire to extend outwards from the inner cavity of the housing and rotation of the handle in a second direction causes the wire to retract into the inner cavity of the housing; and an adaptor disposed at an opposite end of the housing, the adaptor coupled to a drainage pipe of a plumbing system.

* * * * *